US010443970B2

(12) United States Patent
Radl et al.

(10) Patent No.: US 10,443,970 B2
(45) Date of Patent: Oct. 15, 2019

(54) LAUNCH CANISTER TO SIMULATE PERSONAL AND ANTI-PERSONNEL ARMAMENTS

(71) Applicants: Aaron L Radl, Sandy, UT (US); Matt Diffley, Salt Lake City, UT (US)

(72) Inventors: Aaron L Radl, Sandy, UT (US); Matt Diffley, Salt Lake City, UT (US)

( * ) Notice: Subject to any disclaimer, the term of this patent is extended or adjusted under 35 U.S.C. 154(b) by 0 days.

(21) Appl. No.: 15/873,694

(22) Filed: Jan. 17, 2018

(65) Prior Publication Data

US 2018/0202751 A1 Jul. 19, 2018

Related U.S. Application Data

(60) Provisional application No. 62/447,317, filed on Jan. 17, 2017.

(51) Int. Cl.

| | |
|---|---|
| ***F41B 11/55*** | (2013.01) |
| ***F41A 21/16*** | (2006.01) |
| ***F41A 33/00*** | (2006.01) |
| ***F42B 8/02*** | (2006.01) |
| ***F42B 8/10*** | (2006.01) |
| ***F41A 9/72*** | (2006.01) |
| ***F41A 21/06*** | (2006.01) |

(52) U.S. Cl.

CPC ..... *F41B 11/55* (2013.01); *F41A 9/72* (2013.01); *F41A 21/06* (2013.01); *F41A 21/16* (2013.01); *F41A 33/00* (2013.01); *F42B 8/02* (2013.01); *F42B 8/10* (2013.01)

(58) Field of Classification Search

CPC .... F41B 11/55; F42B 8/02; F42B 8/10; F41A 9/72; F41A 21/06; F41A 21/16; F41A 33/00

USPC ..... 124/59; 102/438, 444, 489

See application file for complete search history.

(56) References Cited

U.S. PATENT DOCUMENTS

| | | | | |
|---|---|---|---|---|
| 3,429,262 | A * | 2/1969 | Kincheloe | F41A 19/22 102/438 |
| 3,916,794 | A * | 11/1975 | Mayer | F42B 12/58 102/489 |
| 4,036,141 | A * | 7/1977 | Korr | F42B 5/035 102/438 |
| 5,221,809 | A * | 6/1993 | Cuadros | F42B 12/34 102/439 |
| 5,652,407 | A * | 7/1997 | Carbone | F42B 5/03 102/438 |
| 7,305,981 | B1 * | 12/2007 | Lin | F41B 11/62 124/59 |
| 2005/0262996 | A1 * | 12/2005 | O'Dwyer | F41A 9/36 89/12 |

(Continued)

FOREIGN PATENT DOCUMENTS

| | | | | |
|---|---|---|---|---|
| WO | WO-2015114493 | A1 * | 8/2015 | F41A 9/83 |

*Primary Examiner* — Bret Hayes

(74) *Attorney, Agent, or Firm* — Dobbin IP Law P.C.; Geoffrey E. Dobbin

(57) ABSTRACT

A launch canister for non-lethal pellets may be used to simulate the use of both personal and anti-personnel weapons. The canister features at least two components, an inner core and outer shell, that are nested and both featuring a plurality of launch bores. Gaskets ring the outside surface of the components, but have slight interface with the internal bores. The gaskets then hold a stack of pellets within each bore until the canister is placed in a launch device and the payload released.

16 Claims, 6 Drawing Sheets

(56) References Cited

U.S. PATENT DOCUMENTS

2012/0037138 A1* 2/2012 Huebl ..... F41A 9/26
124/56

* cited by examiner

LAUNCH CANISTER TO SIMULATE PERSONAL AND ANTI-PERSONNEL ARMAMENTS

CROSS-REFERENCES TO RELATED APPLICATIONS

This Application claims priority on prior filed U.S. Provisional Application No. 62/447,317 filed Jan. 17, 2017 and incorporates the same by reference herein in its entirety.

FIELD OF THE INVENTION

The present invention relates to the fields of recreation and simulated warfare and more particularly relates to a launch canister used to simulate personal weapons and anti-personnel devices.

BACKGROUND OF THE INVENTION

Simulated warfare is a common recreational pass-time in modern days. It may also be used for more serious professional training. Simulated warfare takes many forms, depending on the simulated weapons used. For medieval scenarios, padded or blunted arrows, swords, spears, and other implements are used. Two forms of modern warfare simulation are commonly used, paintball and airsoft. Specialized tools are used for simulating modern warfare and firearms and ordinance. Both simulations utilize a "firearm" which launches a projectile using compressed air, rather than controlled explosions. In paintball, a capsule filled with a specialized paint while in airsoft the pellet is smaller and not filled with anything. Since the lethality of modern, standard weapons is found in the combination of a projectile mass and velocity, both are typically reduced to make simulated warfare safer. The kinetic energy of a projectile is given as $E=mv^2/2$. For comparison, an AR-5 typically fires a 39 g bullet 975 m/s, with kinetic energy of 1854 joules and a 9 mm handgun typically fires a 75 g bullet 286 m/s with kinetic energy of 467 joules. A .68 caliber paintball has a mass of about 3 g and is typically fired at 90 m/s (a little over 12 joules) and an airsoft pellet typically has a mass of 0.2 g and is fired at about 110 m/s in close quarters situations (higher for outdoors and greater distance) and possesses a kinetic energy of about 1.2 joules. With simple protective clothing and equipment, simulated warfare using paintball or airsoft ammunition is generally seen as a safe and reasonable activity.

As simulated warfare becomes more and more accepted and advanced, new tools are used to simulate modern warfare equipment. One such item of equipment is the anti-personnel device known as the mortar. Mortars have been in use for about 600 years and are like cannons but they have a short barrel and typically fire a low-velocity projectile of significant weight. On impact, a mortar shell will cause significant damage to both personnel and infra-structure. However, simulating a mortar causes significant problems because the damage must be simulated in a safe manner. To this end, mortars, cannons, and other types of these devices are typically simulated by using either a light weight rocket shell (for which hits must be estimated) or a launch canister which will launch large numbers of pellets at the same time in a general direction. With the latter, the sheer number of pellets replaces a single, heavier projectile, and provides an approximation of the area affected with the damage such a projectile could inflict. Unfortunately, loading a significant number of pellets into a launch canister is time consuming and the effort can be prohibitive. Therefore, an easier reloading of such canisters would lend itself to the use of such devices and a more accurate simulation.

Grenades are also a common feature in modern warfare which may be simulated. Early grenades date back to the 8th century AD and are small explosives typically thrown by hand, but more recently have been rocket propelled. Like the mortar, these devices tend to be simulated by a rocket or a light casing which is thrown or launched into an area where a referee calls out hits.

The present invention is a modular constructed launch canister for a plurality of loaded simulated ammunition pellets. The canister is gas fed and enables the launch of the entire plurality of pellets at one time in a general direction. These pellets then disburse slightly on launch and through travel to an impact zone. Everything in the impact zone is hit with a portion of the pellets. The canister, or shell, may then be reloaded quickly for reuse. This construction may be used to simulate any weapon wherein a plurality of pellets may accurately approximate the range of impact. Such weapons would include grenades, mortars, artillery, canister shells, shotguns or any other suitable weapon. The only issue in such approximations would be appropriately scaling up or down the launch canister and propellant. Likewise, the launch canister may be made for any non-lethal pellets, including but not limited to AIRSOFT and paintball pellets.

The present invention represents a departure from the prior art in that the simulated anti-personnel simulation device of the present invention allows for more realistic impact determination while quickly and effectively reloading the same for reuse.

SUMMARY OF THE INVENTION

In view of the foregoing disadvantages inherent in the known types of simulated armaments, this invention provides a reloadable launch canister which contains and launches a plurality of non-lethal pellets to simulate use of a given weapon. As such, the present invention's general purpose is to provide a new and improved launch canister that is easily constructed, easily made to simulate various forms of weapons fire, easily reloadable, rugged, and easy to use.

To accomplish these objectives, the launch canister comprises a multi-part construction of at least an outer shell and inner core. Each maim component presents a plurality of bores in which non-lethal pellets are loaded and contained. Loading may be accomplished by any known or later developed method. Gaskets retain the pellets in position. The canister may then be loaded into a launch device and propellant pressure used to fire the pellets en masse and in a non-lethal manner towards opponents.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the launch vehicle is herein described. It should be noted that the articles "a", "an", and "the", as used in this specification, include plural referents unless the content clearly dictates otherwise.

Figure 1:
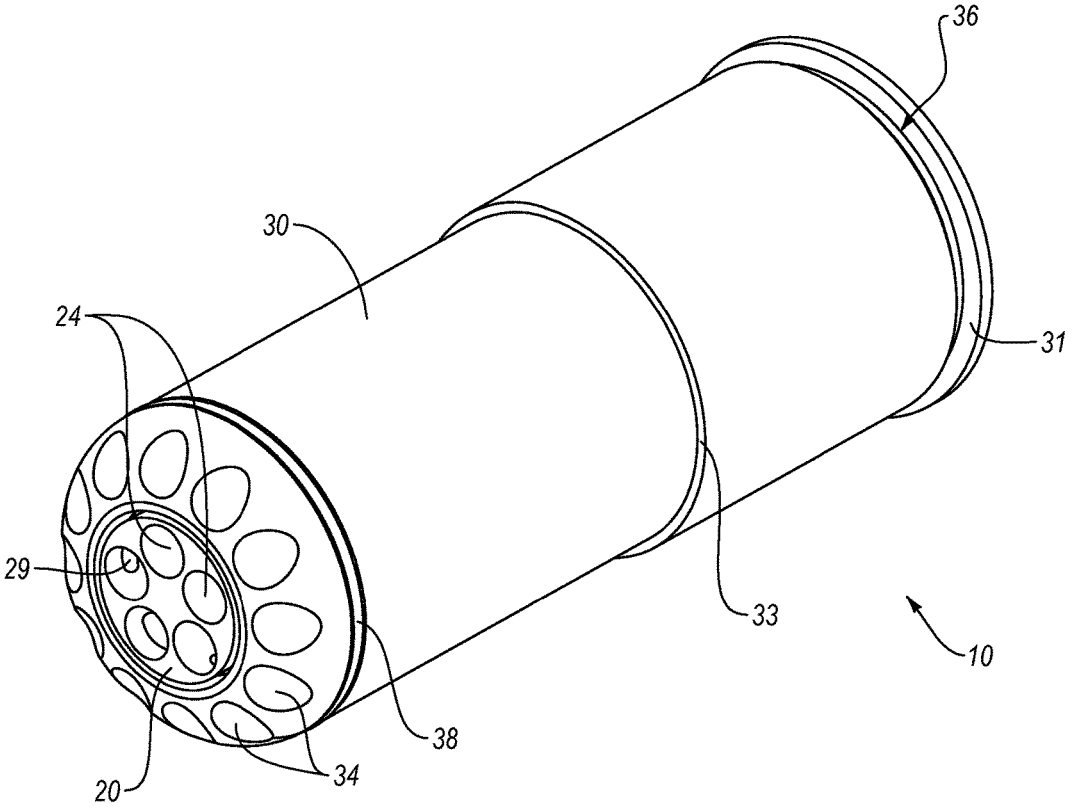
FIG. 1 is a perspective view of one embodiment of a launch canister.
Figure 2:
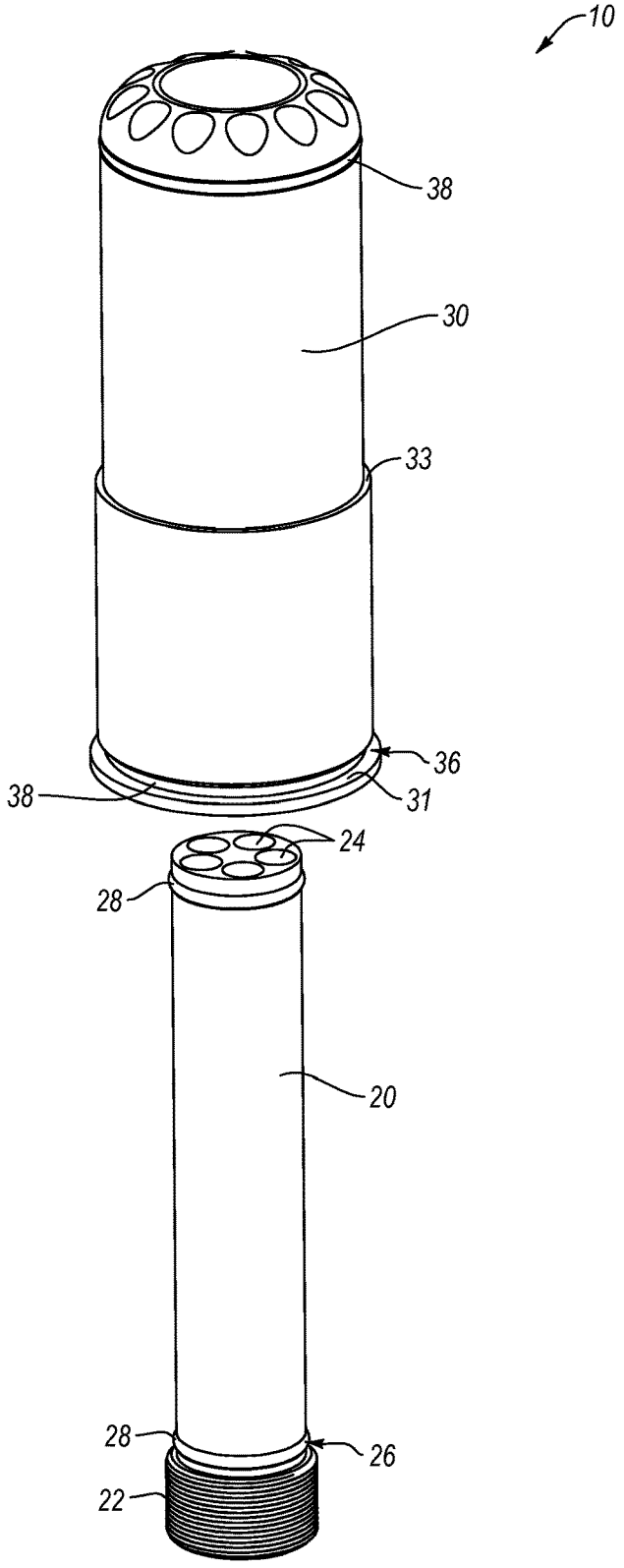
FIG. 2 is an exploded view of the launch canister of FIG. 1.

With reference to FIGS. 1 and 2, the launch canister 10 may be manufactured with two main components: an inner core 20 and an outer shell 30. Both inner core 20 and outer shell 30 are depicted in the figures as round cylinders; however, the use of any prismatic polyhedron would also be conceivable so the terms "cylinder" and "cylindrical" should be broadly interpreted to include suitable polyhedrons. The inner core 20 nests within the outer shell 30 and may be secured with a threading interface 22. Each component may then feature a plurality of bores 24, 34 extending longitudinally therethrough. Each bore 24, 34 being parallel to a longitudinal axis which corresponds to a similar axis in the launch device 40 and a general direction of fire. Ideally, two circumferential troughs 26, 36 are positioned towards a front and a rear of each component. These troughs 26, 36 should just barely interface with each bore 24, 34. Gaskets 28, 38 may then be positioned in each trough in a manner that a portion, or stop section, of each gasket may pass into each bore 29, 39 though the interface each bore 24, 34 has with the troughs 26, 36.

Figure 6:
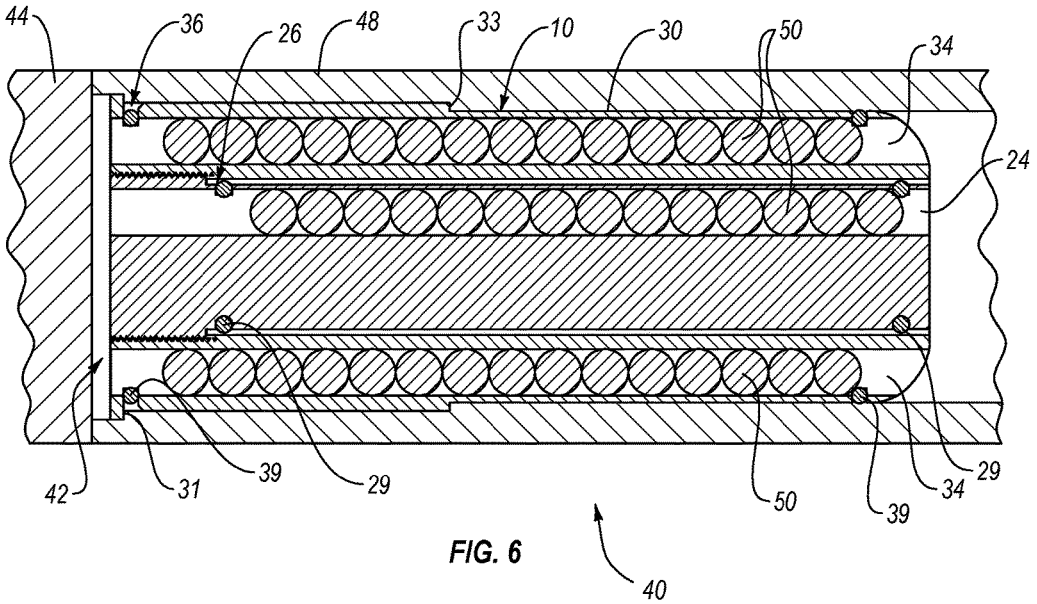
FIG. 6 is a sectional view of the assembly of FIG. 5.

Pellets 50 may be loaded into each bore 24, 34 as shown in FIG. 6. The number of pellets 50 contained will vary with the size of the canister. The stop sections of gasket 29, 39 keep the pellets 50 in position in the bores 24, 34. In so doing, the pellets 50 are maintained in parallel stacks until sufficient pressure is provided to force the pellets 50 past the stop sections 29, 39 of each gasket. Gaskets 28, 38 also serve to provide an airtight seal between components of the launch canister 10 and the launch device 40.

Figure 3:
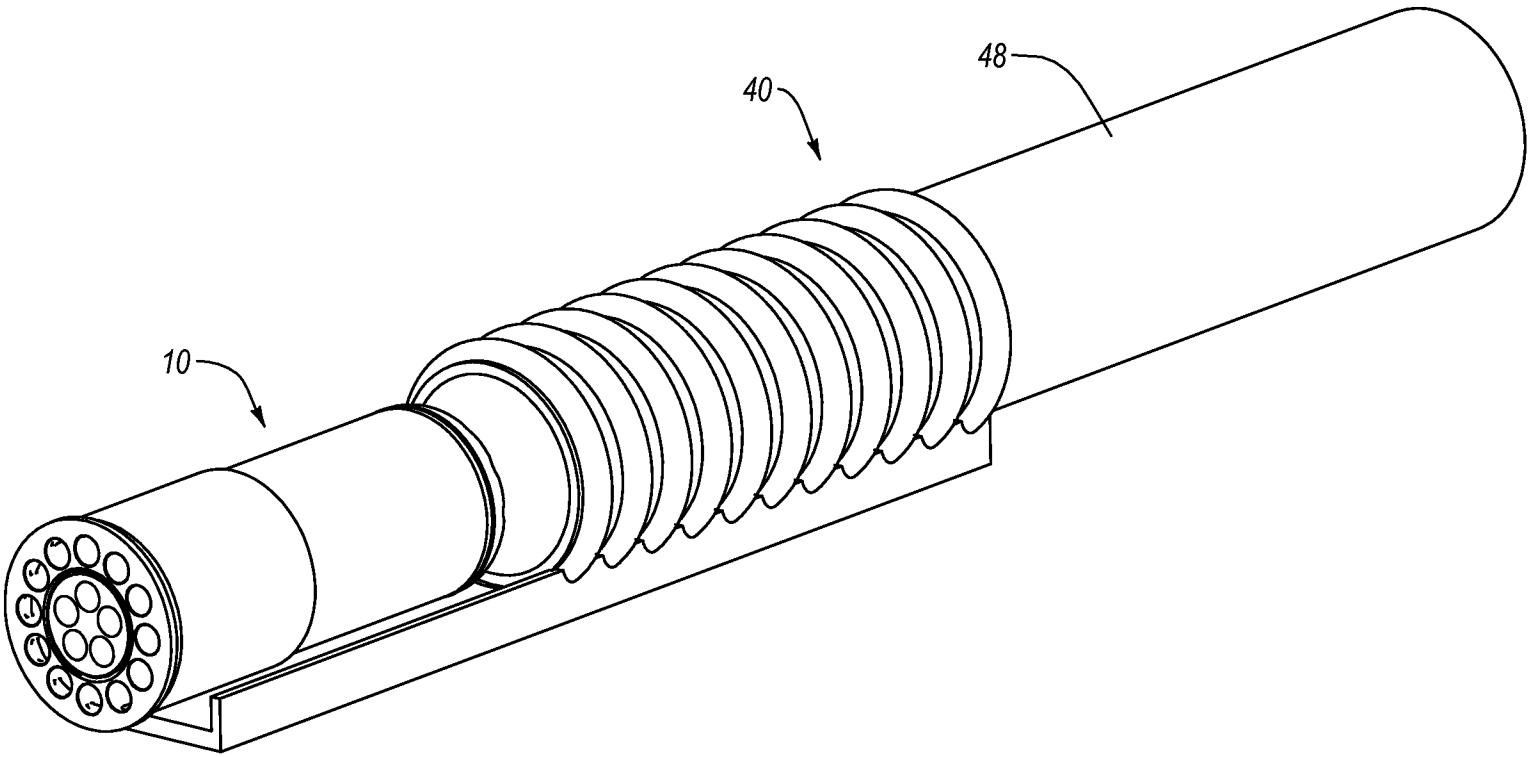
FIG. 3 is a perspective view of the launch canister of FIG. 1, prior to loading in a launch device.
Figure 4:
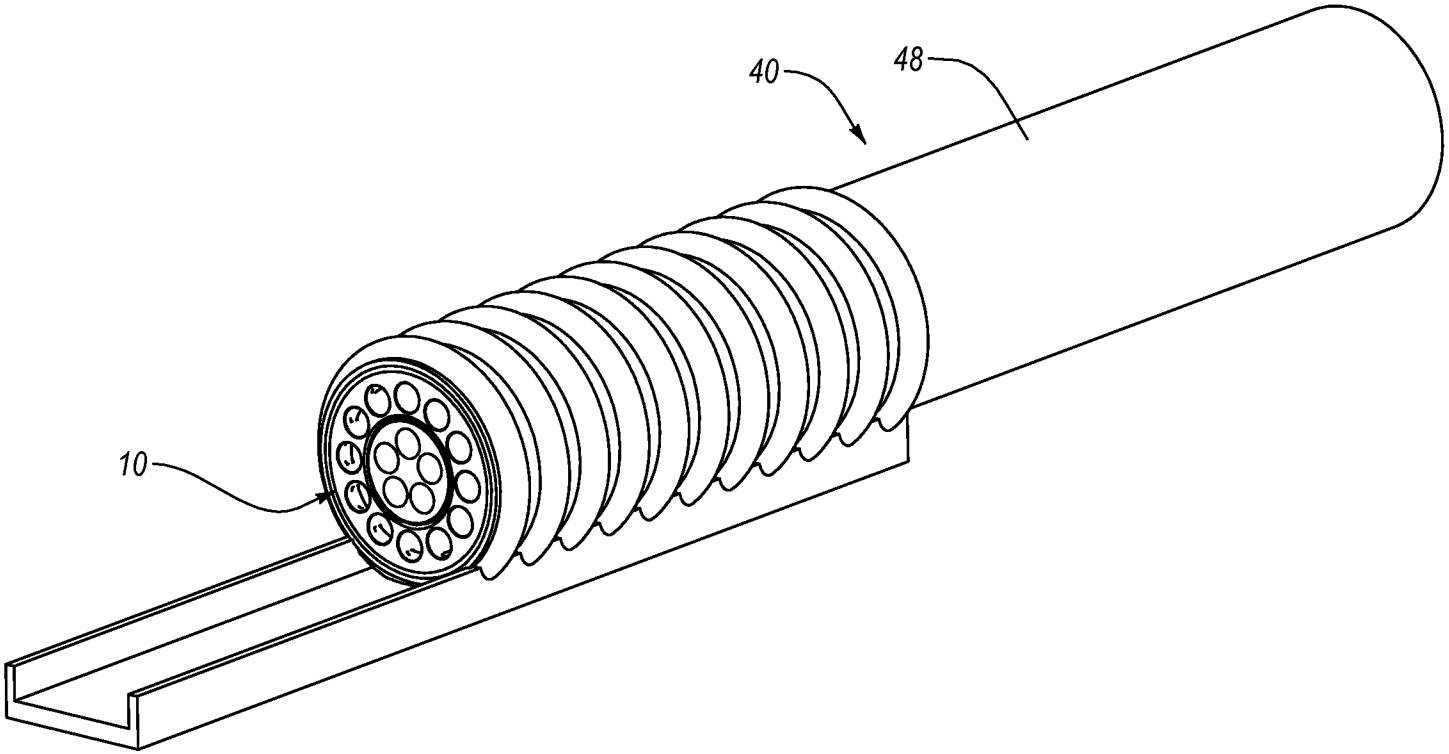
FIG. 4 is a perspective view of the launch canister of FIG. 3, loaded in the launch device.
Figure 5:
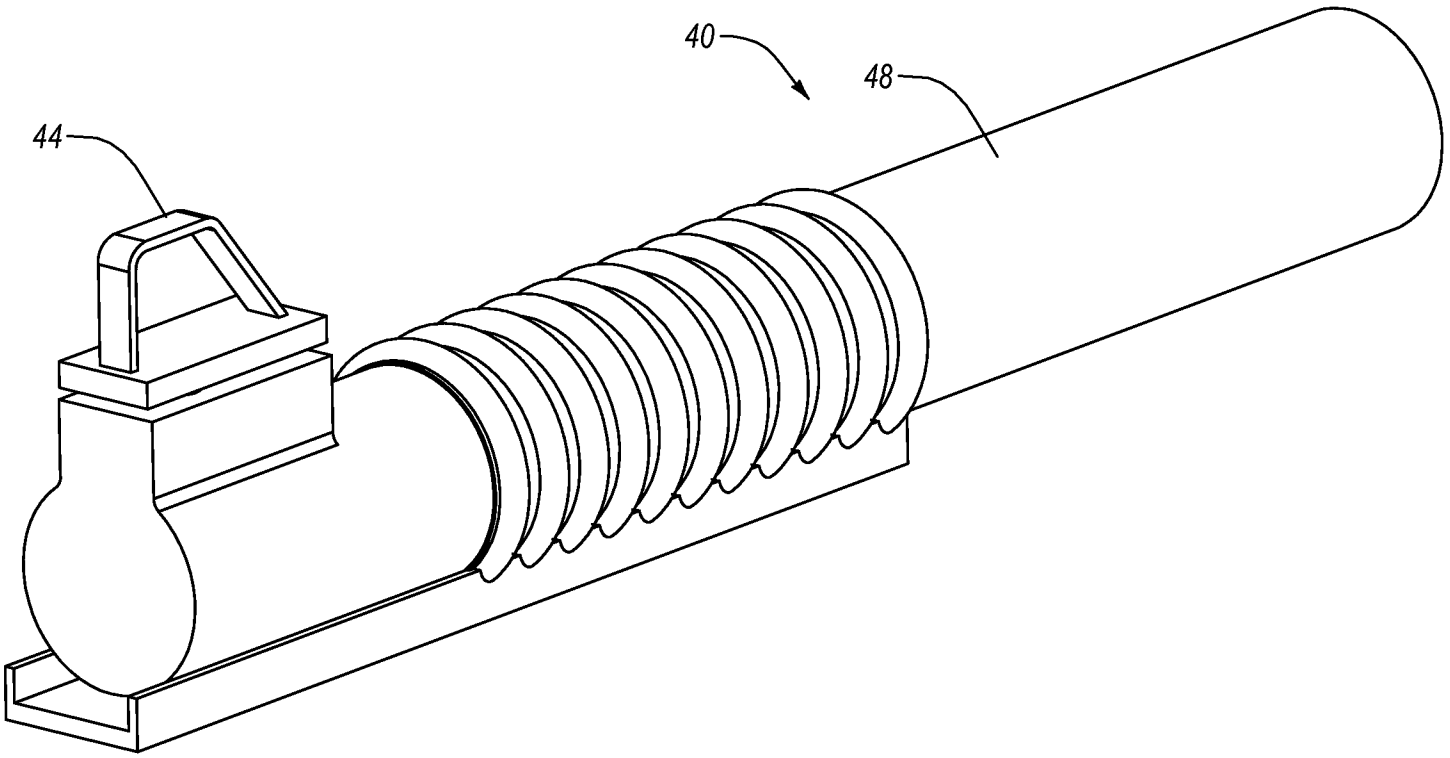
FIG. 5 is a perspective view of an assembly comprising the launch canister, the launch device, and a gas supply/control.

A launch device 40 of any design may be provided, FIGS. 3-5. An ideal launch device 40 will have a chamber 42 with a geometry sufficient to receive the launch canister 10. To this end, various flanges 31 and ridges 33 may be provided the outer shell 30 to achieve this purpose. Pressurized gas may then be applied to the chamber 42. Ideally, there should be a set-off between the launch canister 10 and the gas supply/control 44 so gas pressure may equalize behind all the bores 24, 34. Interfacing geometry of the device 40 should be employed to secure the launch canister 10 inside the chamber at all times. Once sufficient pressure is attained the gas pressure will push the pellets 50 out of the bores 24, 34, through barrel 48 and launching them into a target area.

Although the present invention has been described with reference to preferred embodiments, numerous modifications and variations can be made and still the result will come within the scope of the invention. No limitation with respect to the specific embodiments disclosed herein is intended or should be inferred. It should be noted that the described embodiment is sufficient to create a launch canister with two rings of parallel bores and the construction may be modified readily to create three or more rings of bores by adding intermediate shell bodies to the construction. Likewise, any known or later developed weapon system may be simulated in look, feel, and approximate "lethality" by judicious attention to the physical details of the weapon and the up or downscaling of the launch canister to approximate the damage the real weapon would cause.

What is claimed is:

1. A launch canister for a simulated armament, the canister containing a plurality of non-lethal pellets and comprising:

a. a hollow cylindrical outer canister shell with a length and both outer and inner circumferences, said outer canister shell having a first plurality of cylindrical bores extending through its length and located proximate its outer circumference;

b. a cylindrical inner core with a length, said inner core having an outer circumference and fitting within the hollow canister shell's inner circumference and having a second plurality of cylindrical bores extending through its length and located proximate its outer circumference;

c. means for joining the outer canister shell and the inner core; wherein, each bore of the pluralities of cylindrical bores has a diameter sufficient to accommodate and hold the non-lethal pellets.

2. The launch canister for simulated armament of claim 1, further comprising a plurality of parallel grooves running the outer circumference of the outer canister shell, said grooves intersecting the first plurality of cylindrical bores; and a plurality of gaskets, one residing in each groove such that at least one portion of each gasket impinges into the cylindrical bores.

3. The launch canister for simulated armament of claim 2, further comprising a plurality of parallel grooves running the outer circumference of the inner core, said grooves intersecting the second plurality of cylindrical bores; and a plurality of gaskets, one residing in each groove such that at least one portion of each gasket impinges into the cylindrical bores.

4. The launch canister for simulated armament of claim 1, further comprising a plurality of parallel grooves running the outer circumference of the inner core, said grooves intersecting the second plurality of cylindrical bores; and a plurality of gaskets, one residing in each groove such that at least one portion of each gasket impinges into the cylindrical bores.

5. The launch canister for simulated armament of claim 1, the means for joining the outer canister shell and the inner core being a threaded interface at an end of the launch canister.

6. The launch canister for simulated armament of claim 5, further comprising a plurality of parallel grooves running the outer circumference of the outer canister shell, said grooves intersecting the first plurality of cylindrical bores; and a plurality of gaskets, one residing in each groove such that at least one portion of each gasket impinges into the cylindrical bores.

7. The launch canister for simulated armament of claim 6, further comprising a plurality of parallel grooves running the outer circumference of the inner core, said grooves intersecting the second plurality of cylindrical bores; and a plurality of gaskets, one residing in each groove such that at least one portion of each gasket impinges into the cylindrical bores.

8. The launch canister for simulated armament of claim 5, further comprising a plurality of parallel grooves running the outer circumference of the inner core, said grooves intersecting the second plurality of cylindrical bores; and a plurality of gaskets, one residing in each groove such that at least one portion of each gasket impinges into the cylindrical bores.

9. A simulated anti-personnel armament comprising:

a. an armament receiver with a barrel;

b. a gas supply in fluid communication with the receiver barrel;

c. a launch canister for containing non-lethal ammunition for the simulated anti-personnel armament, the launch canister fitting within the barrel of the armament receiver and further comprising:

i. a hollow cylindrical outer canister shell with a length, said outer canister shell having a first plurality of cylindrical bores extending through its length and located proximate its outer circumference;

ii. a cylindrical inner core with a length, said inner core fitting within the hollow canister shell and having a second plurality of cylindrical bores extending through its length and located proximate its outer circumference;

iii. means for joining the outer canister shell and the inner core;

iv. the outer canister shell fitting within an interior of the receiver barrel but leaving a space between a bottom of the receiver barrel and a bottom of the outer canister shell into which the gas supply empties;

wherein, each bore of the pluralities of cylindrical bores has a diameter sufficient to accommodate and hold the non-lethal ammunition and the launch canister seals the barrel of the armament so as to allow a build-up of gas pressure which will launch the non-lethal ammunition from the canister.

10. The launch canister for simulated armament of claim 9, further comprising a plurality of parallel grooves running the outer circumference of the outer canister shell, said grooves intersecting the circumferential cylindrical bores; and a plurality of gaskets, one residing in each groove such that the gaskets seal the launch canister against the barrel and at least one portion of each gasket impinges into the cylindrical bores.

11. The launch canister or simulated armament of claim 10, further comprising a plurality of parallel grooves running the outer circumference of the inner core, said grooves intersecting the cylindrical bores; and a plurality of gaskets, one residing in each groove such that at least one portion of each gasket impinges into the cylindrical bores.

12. The launch canister for simulated armament of claim 9, further comprising a plurality of parallel grooves running the outer circumference of the inner core, said grooves intersecting the cylindrical bores; and a plurality of gaskets, one residing in each groove such that at least one portion of each gasket impinges into the cylindrical bores.

13. The launch canister for simulated armament of claim 9, the means for joining the outer canister shell and the inner core being a threaded interface at an end of the launch canister.

14. The launch canister for simulated armament of claim 13, further comprising a plurality of parallel grooves running the outer circumference of the outer canister shell, said grooves intersecting the cylindrical bores; and a plurality of gaskets, one residing in each groove such that the gaskets seal the launch canister against the barrel and at least one portion of each gasket impinges into the cylindrical bores.

15. The launch canister for simulated armament of claim 14, further comprising a plurality of parallel grooves running the outer circumference of the inner core, said grooves intersecting the cylindrical bores; and a plurality of gaskets, one residing in each groove such that at least one portion of each gasket impinges into the cylindrical bores.

16. The launch canister for simulated armament of claim 13, further comprising a plurality of parallel grooves running the outer circumference of the inner core, said grooves intersecting the cylindrical bores; and a plurality of gaskets, one residing in each groove such that at least one portion of each gasket impinges into the cylindrical bores.

* * * * *